US006663118B1

(12) United States Patent
Otsuji et al.

(10) Patent No.: US 6,663,118 B1
(45) **Date of Patent: *Dec. 16, 2003**

(54) SNOWBOARD INTERFACE WITH AN UPPER PORTION THAT TRANSLATES AND ROTATES RELATIVE TO A LOWER PORTION

(75) Inventors: Takashi Otsuji, Sakai (JP); Kazuki Tanaka, Sakai (JP); Brian Dennis, Vashon, WA (US)

(73) Assignee: Shimano, Inc., Sakai (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,638

(22) Filed: Dec. 2, 1998

(51) Int. Cl.[7] ..... B62B 9/04
(52) U.S. Cl. ..... 280/14.22; 280/618; 36/118.2
(58) Field of Search ..... 280/14.22, 14.24, 280/607, 616, 617, 636, 618, 626, 14.21, 611; 36/118.2, 118.7, 117.1, 117.2, 117.5

(56) References Cited

U.S. PATENT DOCUMENTS

| | | | | | |
|---|---|---|---|---|---|
| 3,530,594 | A | | 9/1970 | Vogel | 36/2.5 |
| 3,597,862 | A | | 8/1971 | Vogel | 36/2.5 |
| 3,732,635 | A | * | 5/1973 | Marker | 36/117.5 |
| 3,807,062 | A | | 4/1974 | Spier | 36/2.5 AL |
| 4,351,537 | A | | 9/1982 | Seidel | 280/11.12 |
| 4,509,276 | A | | 4/1985 | Bourque | 36/115 |
| 4,916,835 | A | * | 4/1990 | Begey et al. | 36/118.7 |
| 4,979,760 | A | | 12/1990 | Derrah | 280/607 |
| 5,401,041 | A | | 3/1995 | Jespersen | 280/14.2 |
| 5,406,721 | A | * | 4/1995 | Marcolin | 36/117.2 |
| 5,435,080 | A | | 7/1995 | Meiselman | 36/117 |
| 5,437,466 | A | | 8/1995 | Meibock et al. | 280/11.12 |
| 5,499,461 | A | | 3/1996 | Danezin et al. | 36/117 |
| 5,577,755 | A | * | 11/1996 | Metzger et al. | 280/14.2 |
| 5,727,797 | A | * | 3/1998 | Bowles | 280/14.2 |
| 5,771,609 | A | | 6/1998 | Messmer | 36/89 |
| 5,901,971 | A | * | 5/1999 | Eaton | 280/14.2 |
| 5,915,720 | A | * | 6/1999 | Turner et al. | 280/617 |
| 5,954,357 | A | * | 9/1999 | Golling | 280/14.2 |
| 5,975,557 | A | * | 11/1999 | Snoke et al. | 280/14.2 |
| 6,012,237 | A | | 1/2000 | Okajima et al. | 36/118.2 |

FOREIGN PATENT DOCUMENTS

| | | |
|---|---|---|
| AT | 399637 B | 6/1995 |
| DE | 3622746 A1 | 1/1988 |
| DE | 4333503 A1 | 4/1995 |
| DE | 19758190 A1 | 8/1998 |
| EP | 356400 A2 | 2/1990 |
| EP | 646334 A1 | 4/1995 |
| EP | 772982 A2 | 5/1997 |
| FR | 2719197 | 11/1995 |
| WO | 98/31247 | 7/1998 |

* cited by examiner

*Primary Examiner*—Brian L. Johnson
*Assistant Examiner*—Hau Phan
(74) *Attorney, Agent, or Firm*—James A. Deland

(57) ABSTRACT

A snowboard interface has an upper interface and a lower interface, wherein the upper interface rotates and translates relative to the lower interface.

29 Claims, 8 Drawing Sheets

SNOWBOARD INTERFACE WITH AN UPPER PORTION THAT TRANSLATES AND ROTATES RELATIVE TO A LOWER PORTION

BACKGROUND OF THE INVENTION

The present invention is directed to snowboard devices and, more particularly, to a snowboard boot, binding or other rider interface with an upper portion, such as a leg interface, that translates and rotates relative to a lower portion, such as a foot interface.

Snowboarders usually stand on the snowboard facing generally perpendicular to the longitudinal axis of the snowboard. To accomplish various maneuvers on the snowboard, the snowboarder must often shift his or her center of gravity forward or rearward in the long direction of the snowboard. This usually requires the snowboarder to be able to pivot his or her legs from side to side around the ankle. Various schemes are known to allow snowboarders to pivot their legs sideways. For example, DE 3,622,746 shows a binding with upper and lower sections that pivot around a longitudinal axis of the binding. U.S. Pat. No. 5,401,041 shows a boot with an upper leg section, a lower heel section and a pivot coupling between the upper leg section and the lower heel section, wherein the upper leg section pivots relative to the lower heel section around a longitudinal axis of the boot. Finally, U.S. Pat. No. 5,771,609 shows a boot similar to the boot shown in U.S. Pat. No. 5,401,041 but with the upper leg section and the lower heel section being formed as an insert between flexible inner and outer linings.

The applicant discovered that boots that pivot around a single fixed axis do not really accommodate the anatomical motion required for effective weight transfer on the snowboard. That is because rolling of the heel often accompanies articulation of the ankle during snowboard maneuvers, thus resulting in a more complex overall motion of the leg. Thus, there is a need to make a snowboard boot that accommodates such motion.

SUMMARY OF THE INVENTION

The present invention is directed to a snowboard interface that more closely accommodates the anatomical motion required to articulate the legs from side to side relative to the snowboard. In one embodiment of the present invention, a snowboard interface has an upper interface and a lower interface, wherein the upper interface rotates and translates relative to the lower interface. More specifically, the snowboard interface includes a foot interface, a leg interface and a coupling mechanism for coupling the leg interface to the foot interface so that the leg interface translates sideways and rotates sideways relative to the foot interface. In an even more specific embodiment, the coupling mechanism includes a leg coupling member coupled to the leg interface and a foot coupling member coupled to the foot interface. The leg coupling member moves relative to the foot coupling member, and a guide mechanism is provided for guiding the movement of the leg coupling member relative to the foot coupling member so that the leg coupling member translates and rotates relative to the foot coupling member.

In one form of the guide mechanism, a guide surface is disposed on one of the leg coupling member and the foot coupling member, and an outer peripheral surface is disposed on the other one of the leg coupling member and the foot coupling member so that the outer peripheral surface rolls on the guide surface when the leg coupling member moves relative to the foot coupling member. As a result, a pivot location follows the area of contact between the guide surface and the outer peripheral surface.

In another form of the guide mechanism, a first guide projection extends from one of the leg coupling member and the foot coupling member and a first slot is formed in the other one of the leg coupling member and the foot coupling member, wherein the first guide projection extends into the first slot. To provide additional variation on the movement of the leg coupling member relative to the foot coupling member, the first slot may have a varying width. To fine tune the movement of the leg coupling member relative to the foot coupling member, a second guide projection may extend from one of the leg coupling member and the foot coupling member and a second slot may be formed in the other one of the leg coupling member and the foot coupling member, wherein the second guide projection extends into the second slot. The first guide projection and the first slot cooperate with the second guide projection and the second slot to provide a compound motion of the leg interface relative to the foot interface.

DETAILED DESCRIPTION OF THE EMBODIMENTS

Figure 1:
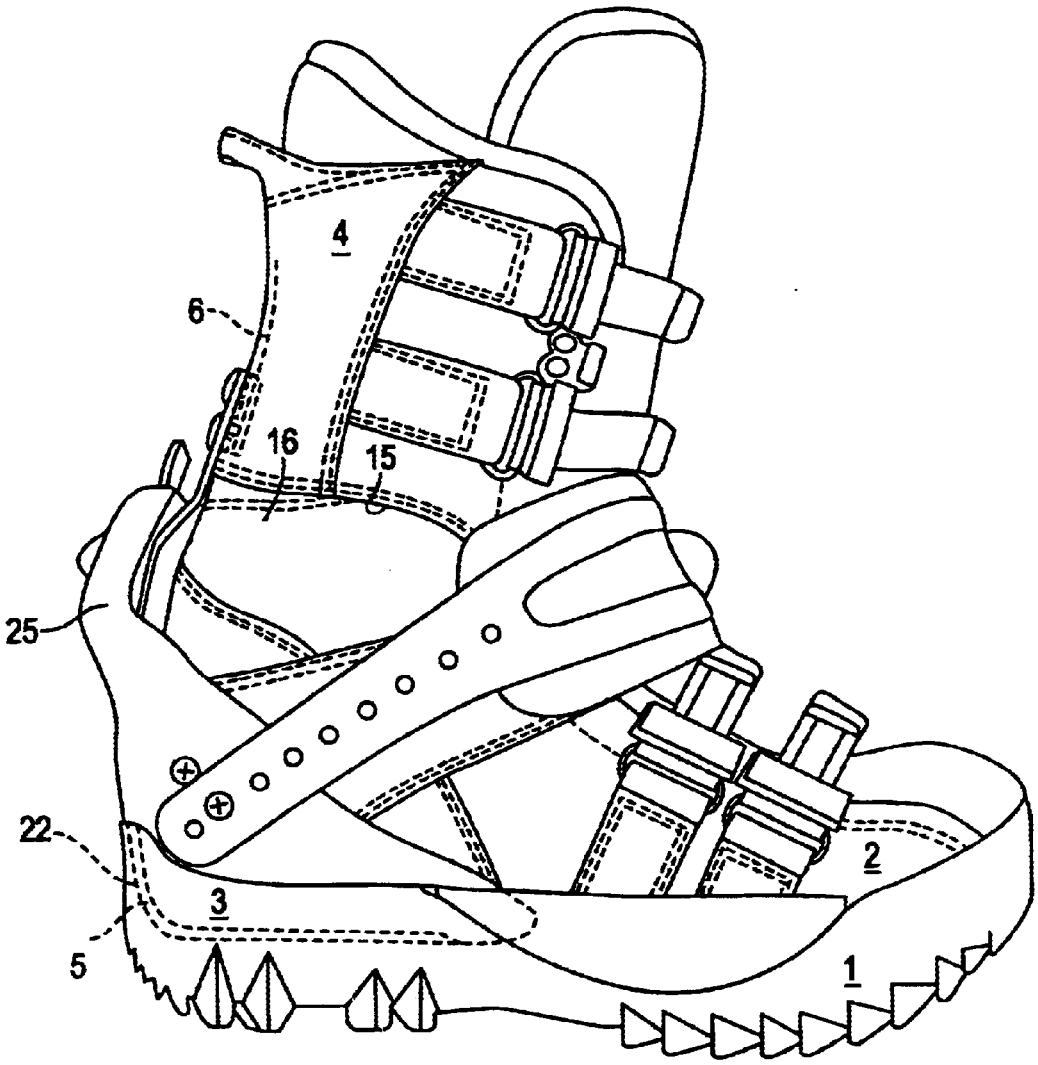
FIG. 1 is a side view of a particular embodiment of a snowboard boot according to the present invention.

FIG. 1 is a side view of a particular embodiment of a snowboard interface according to the present invention in the form of a snowboard boot. As shown in FIG. 1, the snowboard boot is made up of a sole portion 1, a toe portion 2, a lower interface, for example, a foot interface such as a heel portion 3, and a upper interface, for example, a leg interface such an a leg portion 4. In this embodiment, the boot sole 1 is equipped with a liner (not shown) molded from a hard resin. A stiff heel cup 5 makes up a portion of the heel portion 3, either integrally with or independently from the liner in the sole portion 1. Nylon 66® or another such material may be used for the stiff heel cup 5. Heel cup 5 shares the curved shape of the heel portion 3. If desired, heel cup 5 can be molded as a riser portion that rises continuously to the portion extending over the boot sole 1. Heel cup 5 is molded such that it is exposed on the outside of the boot, but it can also be molded such that it is on the inside and cannot be seen. A stiff leg component 6 forms part of the leg portion 4 above the heel cup 5. A cut-out 15 is formed over the center line of a covering 16 formed of a flexible material so that the leg portion 4 may move in a fore and aft direction relative to heel portion 3 as well as side to side relative to heel portion 3.

Figure 2:
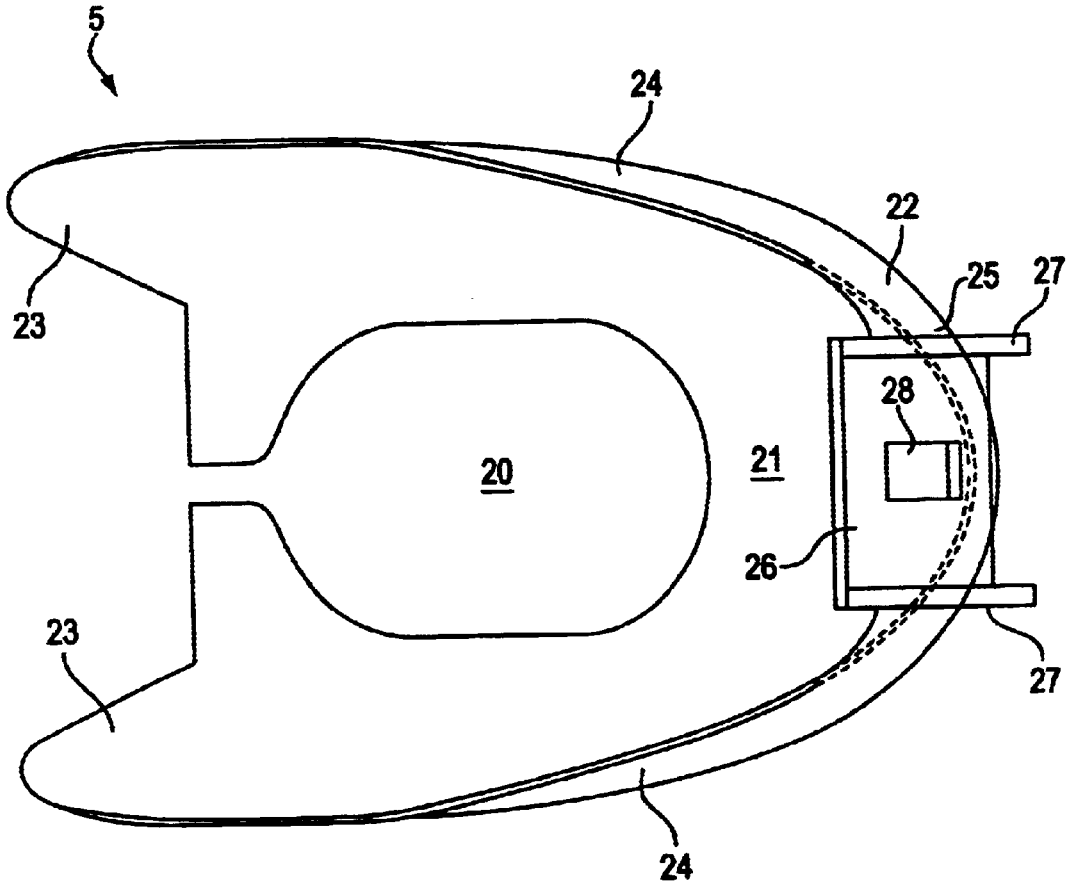
FIG. 2 is a top view of a particular embodiment of a heel cup according to the present invention.

FIG. 2 is a top view of heel cup 5. Heel cup 5 comprises a heel cup bottom 21 with an opening 20, a heel cup heel component 22 (FIG. 1), heel cup bottom extensions 23 that extend forward at the left and right positions from the heel cup bottom 21, and heel cup side components 24 that extend forward at the left and right positions from the heel cup heel component 22 and that curves slightly as it continues to the heel cup bottom 21. A heel cup vertical extension 25 extends upwardly from heel cup heel component 22, and a heel cup guide portion 26 with side guide walls 27 and a vertical slot 28 extends arcuately upwardly from heel cup vertical extension 25.

Figure 3:
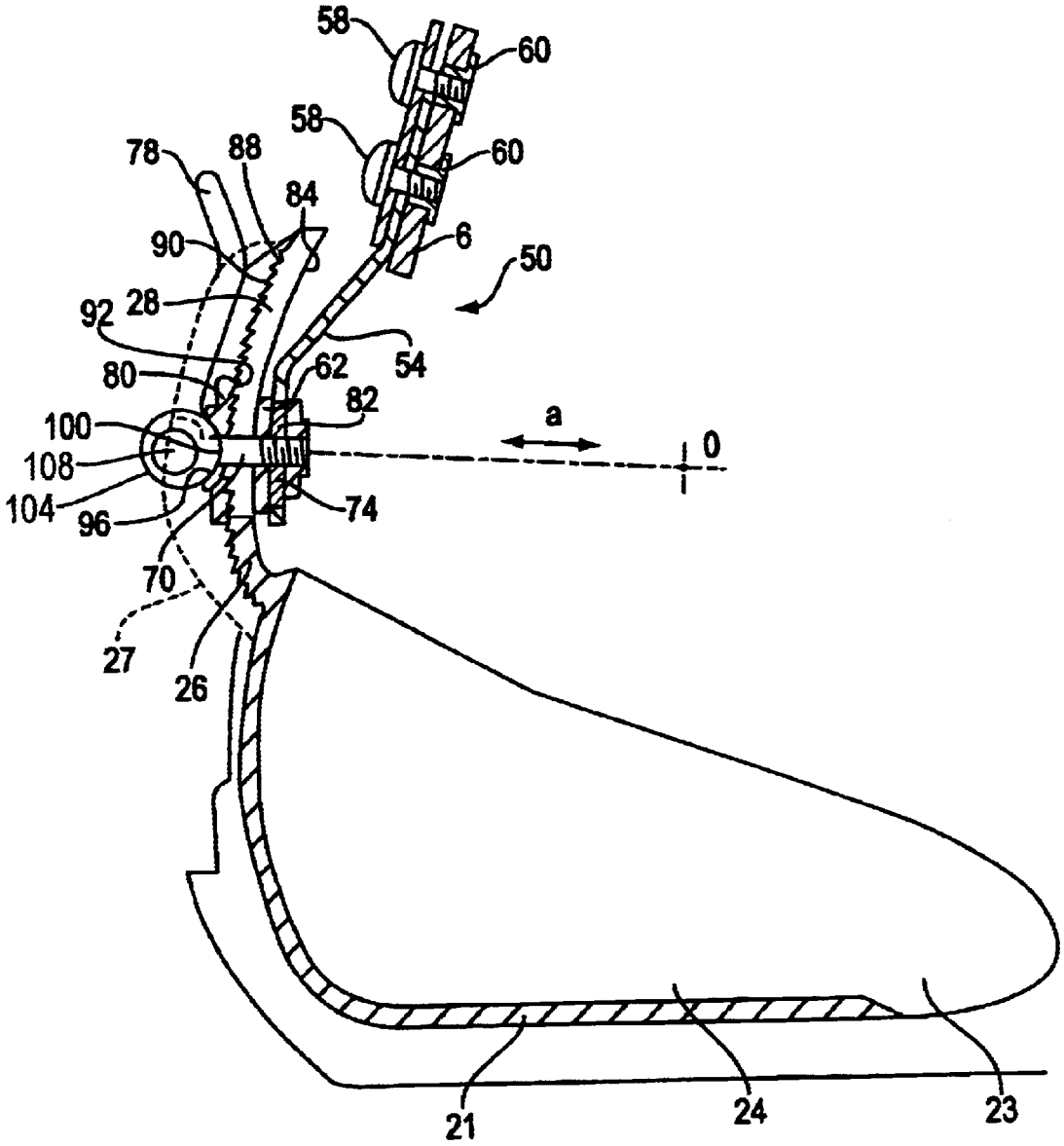
FIG. 3 is a side cross-sectional view of the rear portion of the snowboard boot shown in FIG. 1.
Figure 4:
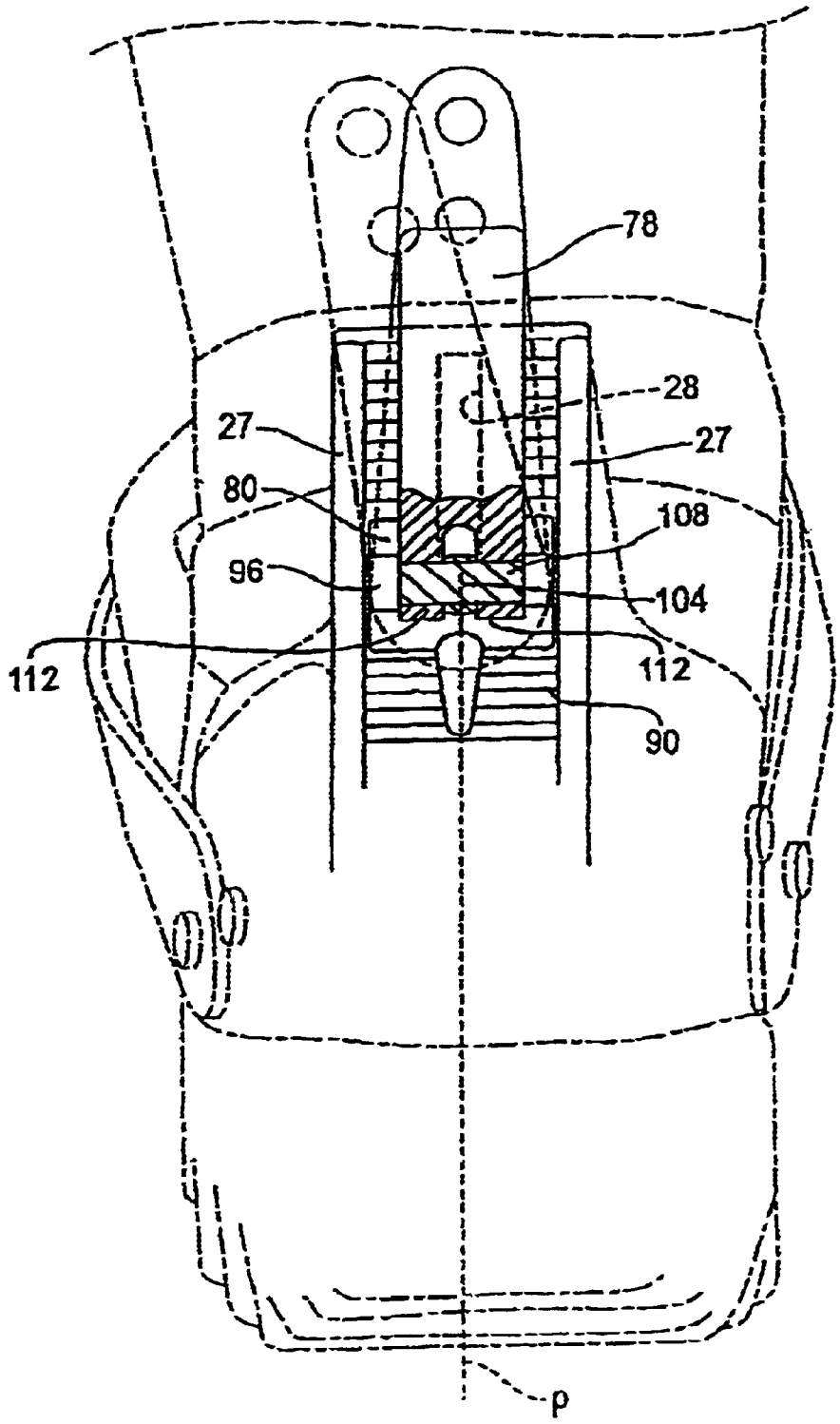
FIG. 4 is a rear view of a particular embodiment of a vertical position fixing mechanism according to the present invention.
Figure 5:
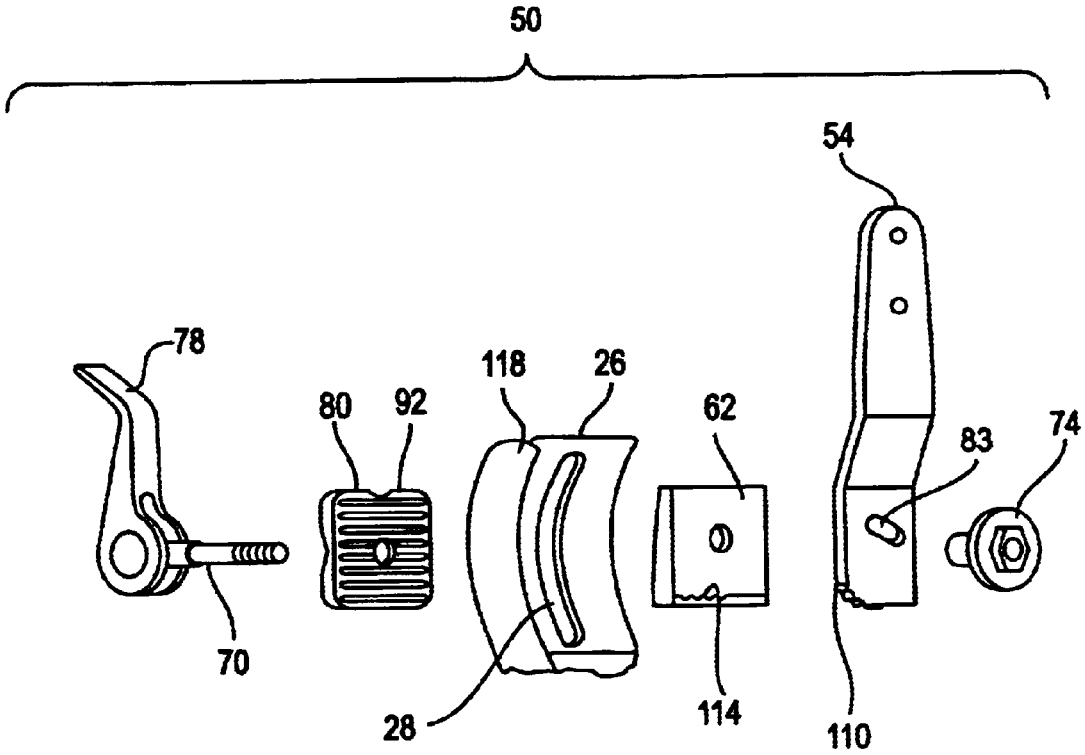
FIG. 5 is an exploded view of a particular embodiment of a coupling mechanism according to the present invention.

FIG. 3 is a side cross-sectional view of the rear portion of the snowboard boot showing how heel cup 5 interacts with a coupling mechanism 50 that fixes a vertical position of leg portion 4 relative to heel portion 3 and that allows leg portion 4 to simultaneously translate and rotate relative to heel portion 3. In other words, leg portion 4 pivot sideways around a rear pivot location that varies as the leg portion pivots. FIG. 4 is a partial rear view of the snowboard boot, and FIG. 5 is an exploded view of coupling mechanism 50.

Coupling mechanism 50 includes a leg coupling member 54 and a foot or heel coupling member 62. Leg coupling member 54 is coupled to the stiff leg portion 6 (and hence leg portion 4) through bolts 58 and nuts 60. Foot coupling member 62 is coupled to heel cup guide portion 26 (an hence heel portion 3) through a position fixing pin or bolt 70 that passes through slot 28 at approximately the longitudinal median plane P of the boot, a nut 74, a release lever 78 and a position fixing plate 80. Leg coupling member 54 is rotatably mounted around bolt 70 through a bushing 82 fitted in an arcuate slot 83 (FIG. 5) so that leg coupling member 54 pivots relative to foot coupling member 62.

As shown in FIGS. 3 and 4, heel cup guide portion 26 includes a generally spherically-shaped concave front surface 84 that slidably contacts a complementary convex rear surface of foot coupling member 62 and a generally spherically-shaped convex rear surface 88 with serrations 90 that mesh with a complementary serrated surface 92 on position fixing plate 80. Leg coupling member 54 is rotatably sandwiched between foot coupling member 62 and nut 74. Position fixing plate 80 has a generally horizontal concave recess 96 that slidably contacts a cam surface 100 of release lever 78. Bolt 70 includes a spherical head 104 with an axle 108 that is fitted within ears 112 of release lever 78.

Rotation of release lever 78 to the position shown in FIG. 3 causes the effective length of bolt 70 to shorten as a result of the camming action between cam surface 100 and concave recess 96. This causes nut 74, bushing 82, foot coupling member 62, heel cup guide portion 26 and position fixing plate 80 to be securely clamped together in the vertical position fixed by the serrated surfaces 90 and 92. Thus, serrations 90 and 92 fix the vertical position of leg coupling member 54, and hence leg portion 4, relative to heel portion 3, while bushing 82 allows leg coupling member 54 to rotate around bolt 70. When release lever 78 is rotated counterclockwise, the camming action between cam surface 100 and concave surface 96 causes the effective length of bolt 70 to increase, thus allowing position fixing plate 80 to disengage from the serrated concave surface 88. This, in turn, allows foot coupling member 62 and position fixing plate 80 to slide along concave surface 84 and convex surface 88, respectively, so that leg coupling member 54 orbits around an imaginary axis O to produce the fore and aft movement of leg portion 4.

As shown more specifically in FIGS. 5 and 6(A)–6(C), leg coupling member 54 has a generally arcuate undulating outer peripheral surface 110 that meshes with a generally horizontal undulating guide surface 114 formed as a ledge on foot coupling member 62. Additionally, slot 83 has an arcuate shape disposed asymmetrically relative to a longitudinal median plane P of the boot. As a result, outer peripheral surface 110 rolls on guide surface 114 so that leg coupling member 54 pivots around a location on a pivot axis (X) defined by the area of contact between outer peripheral surface 110 and guide surface 114. It should be readily apparent that the pivot location, and therefore pivot axis (X), constantly moves in a horizontal direction as leg coupling member 54 pivots, which is much different from any of the prior art boots discussed previously.

Figure 6A:
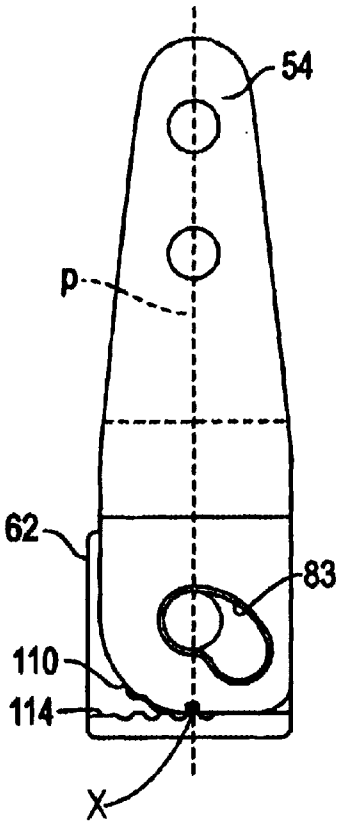
FIGS. 6(A)–6(C) are front views showing the operation of the coupling mechanism shown in FIG. 5.
Figure 6B:
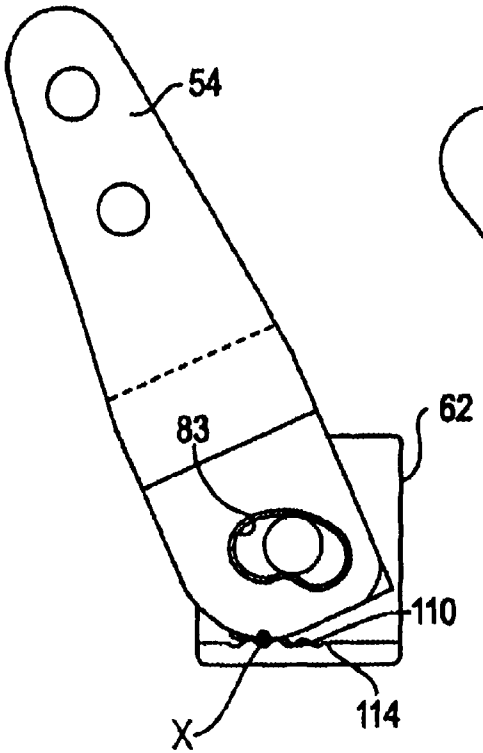
Figure 6C:
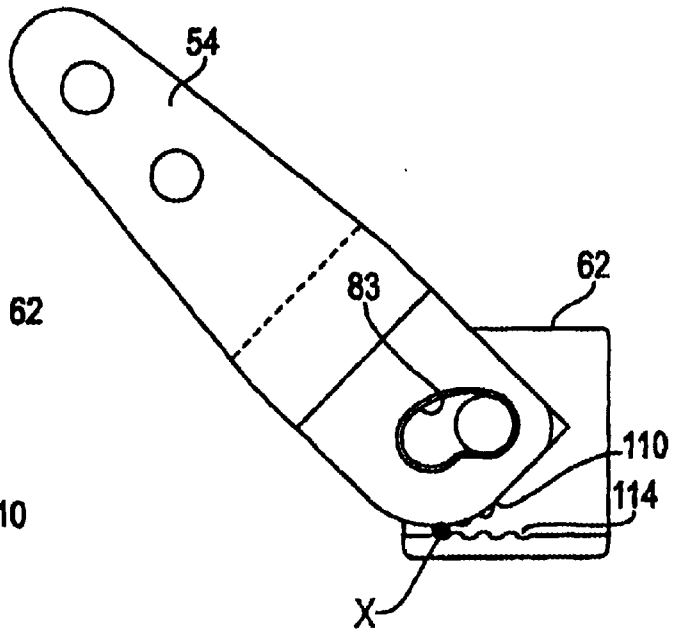

In this embodiment, the asymmetrical slot 83 cooperates with bolt 70, which functions as a guide projection extending from foot coupling member 62, to limit pivoting of leg coupling member 54 to a counterclockwise direction as shown in FIGS. 6(A)–6(C). A side wall 118 (FIG. 5) on vertical extension 26 also inhibits clockwise pivoting of leg coupling member 54. Of course, side wall 118 can be omitted and slot 83 can be symmetrical or otherwise shaped to allow both clockwise and counterclockwise pivoting of leg coupling member 54 if desired for a particular application. The coupling mechanism 50 in this embodiment has particular usefulness in a left side boot, although it could be used in a right side boot depending upon the application.

Figure 7:
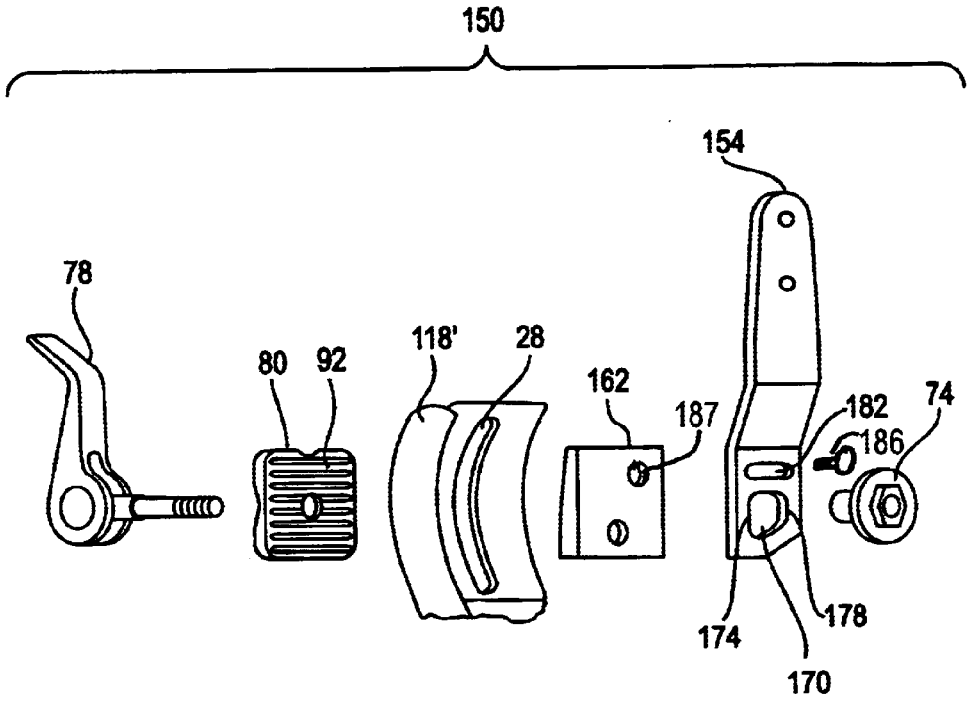
FIG. 7 is an exploded view of another embodiment of a coupling mechanism according to the present invention.

FIG. 7 is an exploded view of a coupling mechanism 150 according to the present invention, and FIGS. 8(A)–8(D) are front views showing the operation of the coupling mechanism 150. Items that are the same as the first embodiment are numbered the same.

Figures 8A, 8B, 8C, 8D:
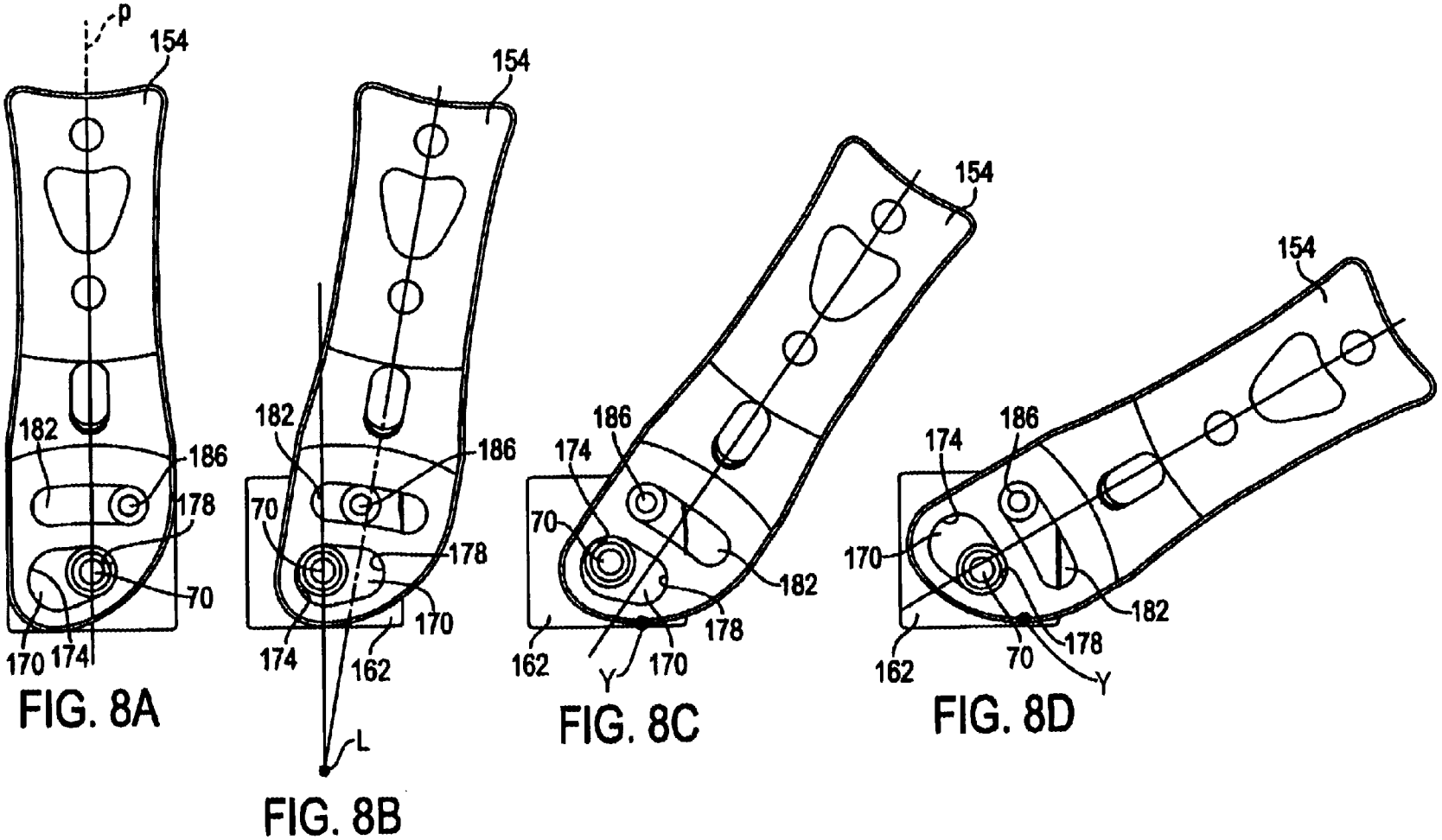
FIGS. 8(A)–8(D) are front views showing the operation of the coupling mechanism shown in FIG. 7.

In this embodiment, coupling mechanism 150 is structured so that a leg coupling member 154 pivots in a clockwise direction. Thus, in contrast to the first embodiment, vertical extension 25 includes a shoulder 118' to inhibit counterclockwise pivoting of leg coupling member 154. A leg coupling member 154 includes a variable width first slot 170 wherein a first end 174 of first slot 170 is wider than a second end 178 of first slot 170. First slot 170 also is asymmetrical relative to the median plane P of the boot as shown in FIG. 8(A), and first slot 170 cooperates with bolt 70, which functions as a first guide projection extending from foot coupling member 162, in a manner described below to produce the desired pivoting effect of leg coupling member 154. Leg coupling member 154 also includes a second slot 182 that is generally symmetrical relative to the longitudinal median plane of the boot. Second slot 182 cooperates with a second guide projection 186 screwed into a threaded opening 187 and extending from foot coupling member 162 offset from the longitudinal median plane of the boot, as well as first slot 182 and first guide projection (bolt) 70, to produce the desired pivoting effect of leg coupling member 154.

As shown in FIGS. 8(A)–8(D), the pivoting action of leg coupling member 154 is much more complicated than the simple rolling action of leg coupling member 54 in the first embodiment. Initially, first guide projection (bolt) 70 is located at the narrower end of slot 170, and second guide projection 186 is located at the right end of slot 182. When a pivoting force directed to the right in FIG. 8(A) is applied to leg coupling member 154, slot 170 moves to the right until first guide projection (bolt) 70 is disposed at the wide end 174 of slot 170 and second guide projection 186 moves within slot 182 to approximately half-way between the ends of slot 182. During this movement there is no predefined pivot location because of the somewhat unguided movement of first guide projection (bolt) 70 within first slot 170 between the ends of the slot as leg coupling member 154 translates and rotates relative to foot coupling member 162. However, when leg coupling member 154 reaches the 10° position shown in FIG. 8(B), the net result is as if the leg coupling member 154 were thereafter prepared to pivot around an imaginary axis L located well below leg coupling member 154.

However, further translation and rotation of leg coupling member 154 does not result in pivoting around axis L because of the wider end 174 of slot 170. Instead, from 10° to approximately 35°, first guide projection (bolt) 70 and second guide projection 186 cooperate with their associated slots 170 and 182 to produce a movement as if the outer peripheral surface of leg coupling member 154 "rolled" around the bottom surface of foot coupling member 162 in a camming action. Of course, unlike the first embodiment, foot coupling member 162 does not have a ledge forming such a bottom surface, so this analogy is for illustrative purposes only. In any event, the net effect is a pivoting of leg coupling member 154 around an imaginary pivot point on a pivot axis (Y) that moves horizontally along the bottom edge of foot coupling member 162.

From approximately 35° to approximately 61° leg coupling member 154 pivots around the offset second guide projection 186 and slot 170 rotates so that first guide projection 70 moves from the wider end of slot 170 to the narrower end of slot 170. The complex compound rotation of leg coupling member 154 in this embodiment more closely approximates the natural movement of the leg inwardly, so this embodiment has particular usefulness in a right side boot, although it could be used in a left side boot depending upon the application.

While the above is a description of various embodiments of the present invention, further modifications may be employed without departing from the spirit and scope of the present invention. For example, the size, shape, location or orientation of the various components may be changed as desired. The functions of one element may be performed by two, and vice versa. It is not necessary for all advantages or functions to be present in a particular embodiment at the same time. The present invention could be applied to a snowboard boot, an insert for a snowboard boot, a binding, or some other interface between the rider and the snowboard. Various mobility functions may be programmed into the interface by designing different contours of the mating surfaces. Thus, the scope of the invention should not be limited by the specific structures disclosed. Instead, the true scope of the invention should be determined by the following claims.

What is claimed is:

1. A snowboard interface comprising:

a foot coupling member for coupling to a forward and rearward extending foot portion of a snowboard boot;

a leg coupling member for coupling to an upwardly extending leg portion of the snowboard boot;

a vertical position fixing mechanism that moves between an unlocked position and a locked position, wherein the leg coupling member can move vertically relative to the foot coupling member when the vertical position fixing mechanism is in the unlocked position, and wherein the leg coupling member is vertically fixed relative to the foot coupling member when the vertical position fixing mechanism is in the locked position; and a coupling mechanism for coupling the leg coupling member to the foot coupling member so that the leg coupling member translates sideways relative to a vertical plane that extends in forward and rearward directions and rotates sideways relative to the foot coupling member around an axis that extends primarily in the forward and rearward directions such that the axis moves sideways as the leg coupling member rotates around the axis while the foot coupling member is stationary and the vertical position fixing mechanism is in the locked position.

2. The snowboard interface according to claim 1 wherein the coupling mechanism is located at a rear of the snowboard interface.

3. A snowboard interface comprising:

a foot coupling member for coupling to a forward and rearward extending foot portion of a snowboard boot;

a leg coupling member for coupling to an upwardly extending leg portion of a snowboard boot;

a vertical position fixing mechanism that moves between an unlocked position and a locked position, wherein the leg coupling member can move vertically relative to the foot coupling member when the vertical position fixing mechanism is in the unlocked position, and wherein the leg coupling member is vertically fixed relative to the foot coupling member when the vertical position fixing mechanism is in the locked position;

a coupling mechanism for coupling the leg coupling member to the foot coupling member so that the leg coupling member translates sideways relative to a vertical plane that extends in forward and rearward directions and rotates sideways relative to the foot coupling member around an axis that extends primarily in the forward and rearward directions such that the axis moves sideways as the leg coupling member rotates around the axis while the foot coupling member is stationary and the vertical position fixing mechanism is in the locked position;

wherein the coupling mechanism includes a guide mechanism for guiding the movement of the leg coupling member relative to the foot coupling member so that the guide mechanism causes the axis to move sideways as the leg portion rotates around the axis while the heel portion is stationary and the vertical position fixing mechanism is in the locked position.

4. The snowboard interface according to claim 3 wherein the guide mechanism comprises:

a guide surface disposed on one of the leg coupling member and the foot coupling member; and an outer peripheral surface disposed on the other one of the leg coupling member and the foot coupling member, wherein the outer peripheral surface essentially nonslidingly rolls on the guide surface when the leg coupling member moves relative to the foot coupling member.

5. The snowboard interface according to claim 4 wherein the guide surface is a generally horizontal surface, and wherein the outer peripheral surface has an arcuate shape.

6. The snowboard interface according to claim 4 wherein the guide surface comprises a first undulating surface, wherein the outer peripheral surface comprises a second undulating surface, and wherein the first undulating surface meshes with the second undulating surface.

7. The snowboard interface according to claim 6 wherein the first undulating surface is generally horizontal, and wherein the second undulating surface has an arcuate shape.

8. The snowboard interface according to claim 3 wherein the guide mechanism comprises a first guide projection extending from one of the leg coupling member and the foot coupling member;

a first slot formed in the other one of the leg coupling member and the foot coupling member; and wherein the first guide projection extends into the first slot.

9. The snowboard interface according to claim 8 wherein the leg coupling member and the foot coupling member are portions of a snowboard boot, and wherein the first slot is horizontally asymmetrical relative to a longitudinal median plane of the boot.

10. The snowboard interface according to claim 9 wherein the first slot has an arcuate shape in a sideways direction.

11. The snowboard interface according to claim 9 wherein the guide mechanism further comprises:

a guide surface disposed on one of the leg coupling member and the foot coupling member; and an outer peripheral surface disposed on the other one of the leg coupling member and the foot coupling member, wherein the outer peripheral surface essentially nonslidingly rolls on the guide surface when the leg coupling member moves relative to the foot coupling member.

12. The snowboard interface according to claim 11 wherein the guide surface is a generally horizontal surface, and wherein the outer peripheral surface has an arcuate shape.

13. The snowboard interface according to claim 11 wherein the guide surface comprises a first undulating surface, wherein the outer peripheral surface comprises a second undulating surface, and wherein the first undulating surface meshes with the second undulating surface.

14. The snowboard interface according to claim 13 wherein the first undulating surface is generally horizontal, and wherein the second undulating surface has an arcuate shape.

15. The snowboard interface according to claim 14 wherein the first guide projection is disposed at the longitudinal median plane of the boot.

16. The snowboard interface according to claim 15 wherein the vertical position fixing mechanism includes a position fixing pin that extends through a vertical slot formed in the snowboard boot, wherein the position fixing pin forms the first guide projection.

17. The snowboard interface according to claim 8 wherein the first slot has a varying horizontal width in the vertical direction.

18. The snowboard interface according to claim 17 wherein the first slot has a first end and a second end, wherein the first end is wider than the second end.

19. The snowboard interface according to claim 17 wherein the guide mechanism comprises:

a second guide projection extending from one of the leg coupling member and the foot coupling member;

a second slot formed in the other one of the leg coupling member and the foot coupling member; and wherein the second guide projection extends into the second slot.

20. The snowboard interface according to claim 19 wherein the leg coupling member and the foot coupling member are portions of a snowboard boot, and wherein the second slot is substantially symmetrical relative to a longitudinal median plane of the boot.

21. The snowboard interface according to claim 19 wherein the leg coupling member and the foot coupling member are portions of a snowboard boot, and wherein the second guide projection is offset from a longitudinal median plane of the boot.

22. The snowboard interface according to claim 21 wherein the second slot is substantially symmetrical relative to the longitudinal median plane of the boot.

23. The snowboard interface according to claim 22 wherein the second slot has an arcuate shape.

24. The snowboard interface according to claim 23 wherein the first guide projection is disposed at the longitudinal median plane of the boot.

25. The snowboard interface according to claim 24 wherein the vertical position fixing mechanism includes a position fixing pin that extends through a vertical slot formed in the snowboard boot, wherein the position fixing pin forms the first guide projection.

26. The snowboard interface according to claim 21 wherein the first slot is asymmetrical relative to a longitudinal median plane of the boot.

27. A snowboard boot comprising:

a toe portion;

a heel portion;

a leg portion;

a vertical position fixing mechanism that moves between an unlocked position and a locked position, wherein the leg portion can move vertically relative to the heel portion when the vertical position fixing mechanism is in the unlocked position, and wherein the leg portion is vertically fixed relative to the heel portion when the vertical position fixing mechanism is in the locked position; and a coupling mechanism for coupling the leg portion to the heel portion so that the leg portion pivots sideways around a rear pivot location disposed on a pivot axis that moves sideways as the leg portion pivots while the foot coupling member is stationary and the vertical position fixing mechanism is in the locked position, wherein the pivot axis extends primarily in a forward and rearward directions between the toe portion and the heel portion, and wherein the pivot axis continues to extend primarily in the forward and rearward directions as the pivot axis moves sideways.

28. A snowboard boot comprising:

a toe portion;

a heel portion;

a leg portion;

a coupling mechanism including a shaft disposed on one of the heel portion and the leg portion extending through an opening disposed on the other one of the heel portion and the leg portion so as to couple the leg portion to the heel portion;

a vertical position fixing mechanism that moves between an unlocked position and a locked position, wherein the leg portion can move vertically relative to the heel portion when the vertical position fixing mechanism is in the unlocked position, and wherein the leg portion is vertically fixed relative to the heel portion when the vertical position fixing mechanism is in the locked position; and wherein the shaft and the opening are structured such that the leg portion pivots centered around an axis extending primarily in forward and rearward directions and located in a position spaced apart from the shaft while the heel portion is stationary and the vertical position is in the locked position, and such that the axis moves sideways as the leg portion rotates around the axis while the heel portion is stationary and the vertical position fixing mechanism is in the locked position.

29. The snowboard boot according to claim 28, wherein the coupling mechanism is located at a rear of the snowboard boot.

* * * * *